United States Patent [19]

Sharp

[11] 4,099,347

[45] Jul. 11, 1978

[54] DOOR HINGES

[76] Inventor: Dennis J. Sharp, 1254 Church St., Reading, Pa. 19601

[21] Appl. No.: 639,129

[22] Filed: Dec. 9, 1975

[51] Int. Cl.[2] ..... E05D 3/02

[52] U.S. Cl. ..... 49/399; 16/128 R; 49/506

[58] Field of Search ..... 16/128 R; 49/501, 399, 49/400, 401, 504, 506

[56] References Cited

U.S. PATENT DOCUMENTS

| | | | |
|---|---|---|---|
| 226,306 | 4/1880 | Gordon | 16/128 R |
| 1,432,782 | 10/1922 | Phillips | 16/128 R |
| 1,893,450 | 1/1933 | Shively | 16/128 R |
| 1,917,321 | 7/1933 | North | 16/128 R |
| 2,315,488 | 4/1973 | Aldeen | 16/128 R |
| 2,790,198 | 4/1957 | Schoen et al. | 16/128 R |
| 3,216,053 | 11/1965 | Felix | 49/399 X |

*Primary Examiner*—Werner H. Schroeder
*Attorney, Agent, or Firm*—M. Richard Page

[57] ABSTRACT

Methods and means are disclosed for supporting doors, windows and the like with improved leaf-type hinges in which the leaf of the hinge mounted against the supporting structure, such as the door frame, is extended laterally to fit beneath and be partially held by the door or window jamb.

3 Claims, 2 Drawing Figures

DOOR HINGES

This invention relates to improved methods and means for hanging doors or windows which are opened and closed by rotating them about an axis established by leaf-type hinges. More particularly, this invention relates to leaf-type hinges in which the leaf portion that mounts against the frame of the door, cabinet or the like, is laterally extended in width so that the leaf or hinge plate may be secured under a jamb. By this means, the hinge is held more securely and heavier doors may more readily be supported.

Accordingly, it is an object of this invention to provide improved leaf-type hinges that have greater load-bearing capacity.

Another object of this invention is to provide leaf-type hinges that may be more securely mounted against a frame.

Another object of this invention is to provide leaf-type hinges that may be more securely mounted against door frames that previously have been used without the need for caulking or filling existing screw holes.

Briefly, these and other objects of this invention are achieved by extending the hinge leaf or plate laterally in the direction of its width whereby the hinge plate or leaf has greater surface area in contact with the frame upon which it is mounted, and the hinge plate or leaf will extend, at least in part, under the jamb and will be partially supported thereby.

Figure 2:
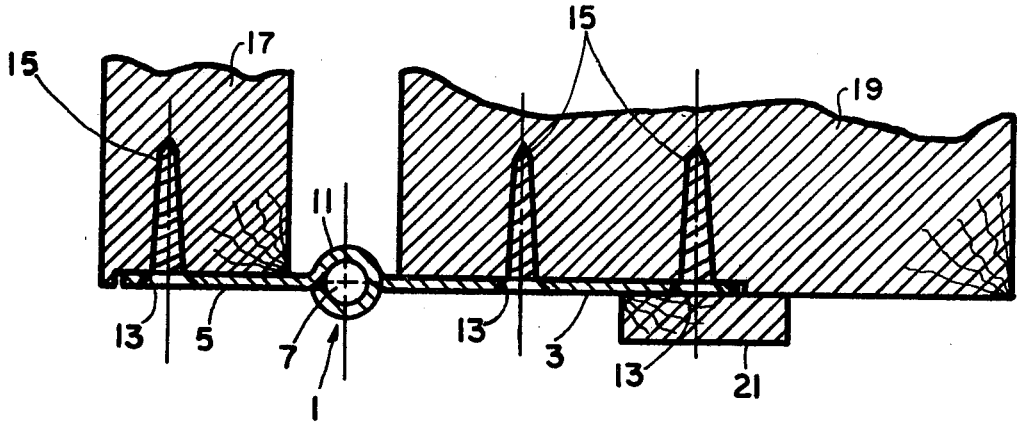
Figure 1:
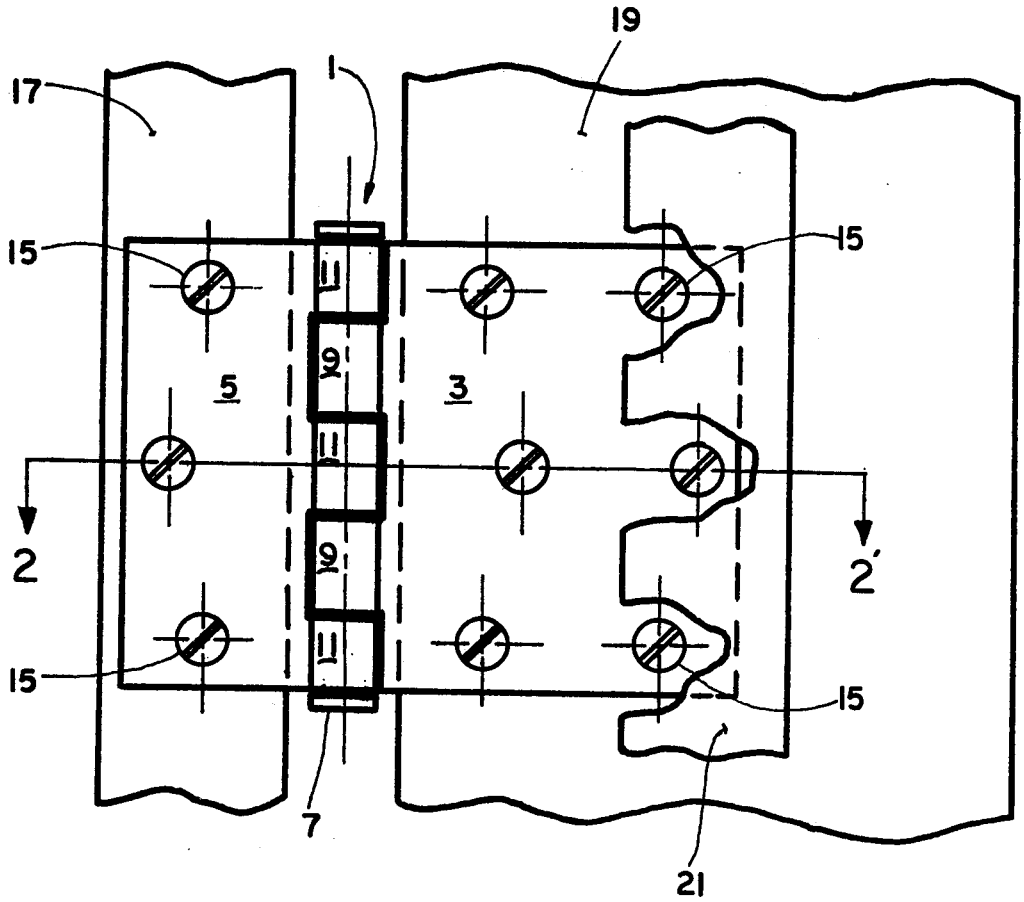

The invention can be better understood in connection with the accompanying drawings in which:

FIG. 1 is a front elevation, partially broken away, of the hinge of this invention, shown in an opened position, secured to a door and a door frame; and FIG. 2 is a view, partially in section, taken along section line 2—2 of FIG. 1.

In the drawing there is illustrated a hinge of the leaf-type construction comprised of two hinge plates or leaves 3 and 5. The hinge plates 3 and 5 are mounted for rotation with respect to each other by tubular bearings (sometimes referred to in the art variously as "pintel pockets" or "knuckles") 9—9 and 11—11 respectively. The tubular bearings 9 associated with hinge plate 3 are spaced apart lengthwise of the continuous edge or strip forming the inner edge of the plate 3 as are the tubular bearings 11—11 on hinge plate 5. The tubular bearings 9—9 and 11—11 are adapted to fit together to form a continuous tubular bearing in which a hinge pin or pintel 7 may be inserted in order to hold the two hinge plates 3 and 5 together for rotation about the axis established by the hinge pin 7.

A plurality of countersunk holes are drilled through the hinge plates 3 and 5 and are adapted to receive in seating relationship wood screws 15.

Hinge plate 5 is adapted to be secured by means of screws 15 onto the edge of a door 17, and hinge plate 3 is adapted to be secured to the door frame or other suitable structure 19.

While not forming a part of this invention, it is preferred that the door and the door frame be morticed so that the hinge 1, when secured to the door 17 and the door frame 19, will fit flush with the surfaces of these elements.

As can be seen in the drawings, hinge plate 3, which is adapted to be mounted against the door frame 19, extends in a radial distance from the hinge pin 7 a considerably longer distance than does hinge plate 5. The purpose of this extension of the width of hinge plate 3 is to permit at least a portion of the hinge plate 3 to be secured under the doorjamb 21. By this method of installation, greater stability is provided to the hinge plate 3 and, as a result, heavier loads and harder usage can be tolerated without loosening the screws 15 that are secured under the doorjamb 21.

Another advantage of this invention lies in the fact that when new doors are hung on existing door frames that have previously had doors mounted on them, an additional area is provided in which to mount screws 15, thus making it unnecessary to rely entirely upon old screw holes which otherwise might have to be caulked or filled.

While in the specification and the appended claims reference is generally made to hinges for supporting doors, it will be appreciated that the invention is equally applicable to other types of closure means such as windows that are mounted for rotation by leaf-type hinges.

I claim:

1. A door, including a door frame, a door, a jamb, and a pair of cooperative hinge plates held together for rotation with respect to each other around a central hinge pin with one of the cooperative hinge plates mounted on the door frame and the other of the pair of hinge plates mounted on the door, characterized in that the hinge plate adapted to be mounted on the door frame extends radially a greater distance from the axis of rotation of the hinge pin than does the hinge plate adapted to be mounted on the door, and in that the doorjamb is mounted over at least a portion of the greater distance of the hinge plate mounted on the door frame.

2. A method for hanging doors by utilizing leaf-type hinges which comprises mounting one hinge plate on the door, mounting the second hinge plate on the door frame, and mounting the doorjamb over a substantial portion of the second hinge plate.

3. A method of mounting a door to a door frame and jamb by means of at least one pair of cooperative hinge plates held together for rotation with respect to each other around a central hinge pin, one hinge plate of each pair extending radially a greater distance from the hinge pin than the other, by:

attaching the narrower hinge plate of each pair to the door;

attaching the wider hinge plate of each pair to the door frame; and mounting the jamb over at least a portion of each wider hinge plate.

* * * * *